US005950358A

United States Patent [19]

Commenator

[11] Patent Number: 5,950,358

[45] Date of Patent: Sep. 14, 1999

[54] COASTER TO SUPPORT WEIGHT AND MOVEMENT OF HEAVY OBJECTS

[76] Inventor: Laura Katherine Commenator, 6120 E. 5th St., #121-B, Tucson, Ariz. 85711-2537

[21] Appl. No.: 09/129,034

[22] Filed: Aug. 4, 1998

[51] Int. Cl.[6] ..... A47G 7/00

[52] U.S. Cl. ..... 47/39

[58] Field of Search ..... 47/65.5, 65.6, 47/71, 39

[56] References Cited

U.S. PATENT DOCUMENTS

| | | | |
|---|---|---|---|
| D. 23,906 | 12/1894 | Symonds | 47/39 |
| 283,840 | 8/1883 | Westphal | 47/39 |
| 396,459 | 1/1889 | Bertrand | 47/39 |
| 585,931 | 7/1897 | Gridley | 47/39 |
| 679,818 | 8/1901 | Alsip | 47/71 |
| 699,154 | 5/1902 | DeForce | 47/39 |
| 1,112,558 | 10/1914 | Red | 47/39 |
| 1,764,543 | 6/1930 | Barton | 47/39 |
| 1,808,402 | 6/1931 | Cooper | 47/39 |
| 1,820,843 | 8/1931 | Spitz | 47/39 |
| 2,707,351 | 5/1955 | Walker | 47/39 |
| 2,947,548 | 8/1960 | Bard | 47/39 |
| 3,528,676 | 9/1970 | Marcandalli | 47/39 |
| 3,676,953 | 7/1972 | Delogne | 47/39 |
| 4,250,666 | 2/1981 | Rakestraw | 47/39 |
| 5,094,031 | 3/1992 | Lee | 47/66 |
| 5,430,973 | 7/1995 | Luo | 47/39 |
| 5,596,839 | 1/1997 | Ellis-El | 47/79 |
| 5,819,469 | 10/1998 | Hsu | 47/39 |

FOREIGN PATENT DOCUMENTS

| | | | |
|---|---|---|---|
| 13246 | 12/1908 | Australia | 47/39 M |
| 192568 | 12/1956 | Austria | 47/39 M |
| 615210 | 2/1961 | Canada | 47/39 S |
| 6257 | 2/1903 | Denmark | 47/71 |
| 561607 | 10/1923 | France | 47/39 P |
| 2667492 | 4/1992 | France | 47/71 |
| 36210 | 7/1886 | Germany | 47/39 M |
| 40/6046944 | 2/1994 | Japan | 47/39 M |
| 6904 | 10/1835 | United Kingdom | 47/39 M |
| 388545 | 3/1933 | United Kingdom | 47/39 M |

OTHER PUBLICATIONS

Popular Science, Wrought Iron Work, A Hobby That Costs little for Tools and Materials, pp. 193–196, Apr. 1939.

*Primary Examiner*—Michael J. Carone
*Assistant Examiner*—Fredrick T. French, III

[57] ABSTRACT

A coaster having a tray member constructed of wrought iron which is supported by casters having ball bearings, and rubber wheels to assist in the smooth and easy movement of the potted plant. A hole in the center of the tray allows water draining through the plant to escape. A handle member assists the user in the movement of the tray.

10 Claims, 1 Drawing Sheet

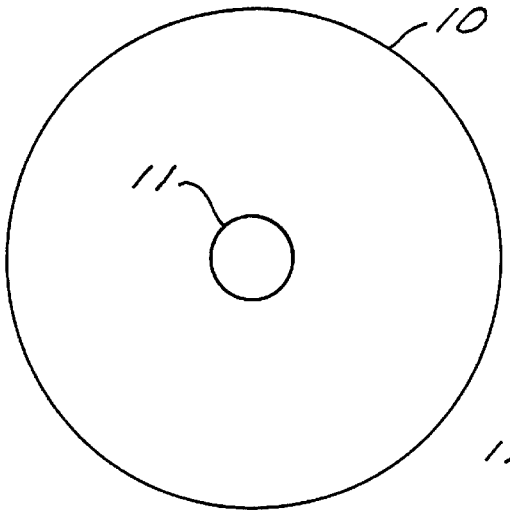
FIG. 1A
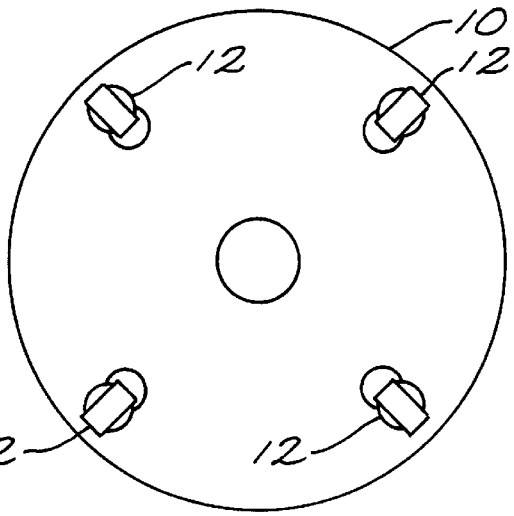
FIG. 1B
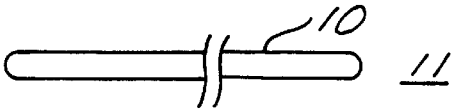
FIG. 1C
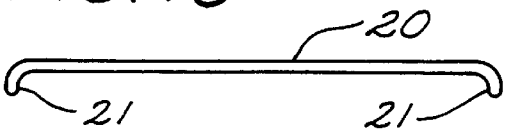
FIG. 2A
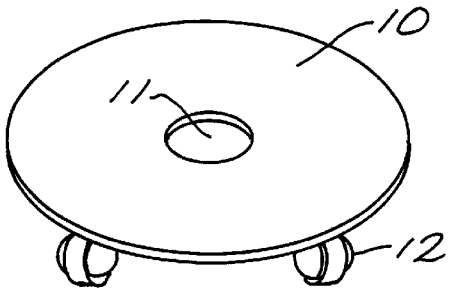
FIG. 1D
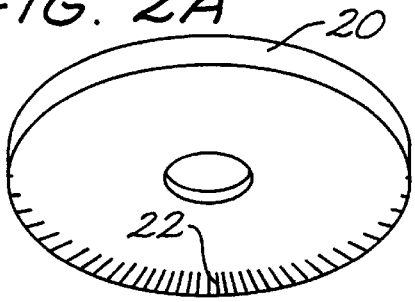
FIG. 2B
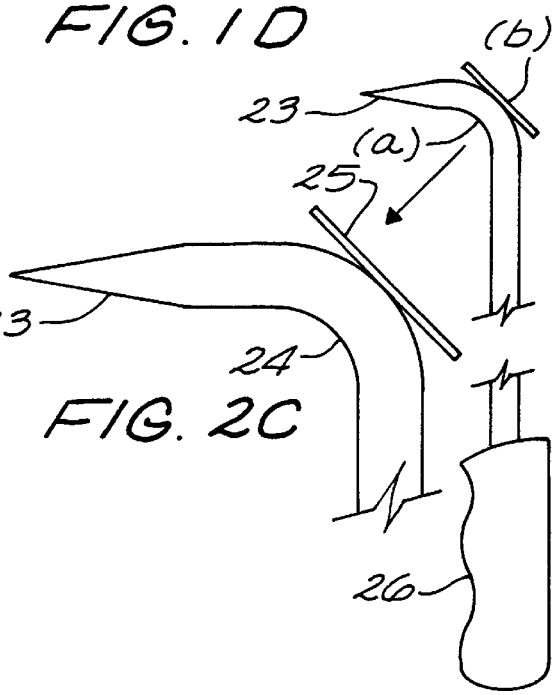
FIG. 2C
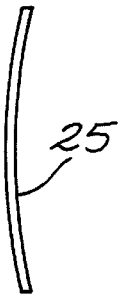
FIG. 2E
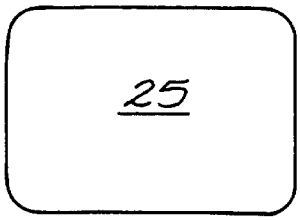
FIG. 2D
FIG. 2F

COASTER TO SUPPORT WEIGHT AND MOVEMENT OF HEAVY OBJECTS

BACKGROUND OF THE INVENTION

This invention relates generally to plants and more particularly to mechanisms used for the movement of plant pots.

The vast majority of plant pots are moved by hand. While this technique is practical for small pots, as the size of the pot (and the plant within it) increases, movement of the pot from one location to another proves to be very difficult.

To this end, a variety of wooden coasters, generally flat, of varying shapes, and supported by casters are available for the moving of heavy potted plants in patios and on decks. Unfortunately, these wooden coasters can be extremely pliable, may not move smoothly, may balk or jerk at any surface irregularity, may break down and, at times, do break down under stress of weight, balance, and movement of heavy potted plants after repeated use.

Available coasters for moving heavy potted plants tend to be somewhat bulky in appearance and appear as simply a supportive moveable structure rather than as an aesthetically harmonious, yet unobtrusive standing base for a potted plant.

There is a need for a strong, yet aesthetically pleasing base on which a heavy potted plant can set, and which when necessary to move the potted plant for care of the plant or maintenance of its setting, will allow safe and easy moving of the potted plant.

It is clear that there is a need for the safe and efficient mechanism to assist in the movement of heavy potted plants.

SUMMARY OF THE INVENTION

The present invention creates a coaster having a tray member constructed of wrought iron. The tray is supported by casters having ball bearings, and rubber wheels to assist in the smooth and easy movement of the potted plant. A hole in the center of the tray allows water draining through the plant to escape.

In this invention, the tray member can be circular or generally in circular shape, or can be angled in shape. It can be void of decorative design or have decorative design. Figures drawn show a plain, circular tray member.

Referring to the figures, figures drawn illustrate the basic design of the invention, with exact specifications for a 16" diameter coaster.

DRAWINGS IN SUMMARY

FIG. 1A shows the topside view of the preferred coaster.

FIG. 1B shows the underside of the preferred coaster.

FIG. 1C shows the beveling of the wrought iron edge around the center hole and the beveling of the outer edge of the tray for the preferred embodiment.

FIG. 1D shows a perspective view of the preferred embodiment.

FIG. 2A shows a cross section of an alternative embodiment.

FIG. 2B shows a narrow ribbed edging on the alternative embodiment.

FIG. 2C shows the lower end of the wrought iron tool's shaft.

FIG. 2D shows the thin gauged wrought iron cross brace used for the tool.

FIG. 2E shows a side view of the cross brace for the tool.

FIG. 2F shows the upper end of the tool shaft with a handle for gripping.

DRAWINGS IN DETAIL

FIG. 1A shows the topside view of the coaster 10, with its 3/16" wrought iron circular tray member and the 3" diameter hole 11 in the center of the tray member.

FIG. 1B shows the underside of the coaster 10, with its four evenly positioned 2" casters 12 welded to the tray member.

FIG. 1C shows the beveling of the wrought iron edge around the center hole 11 and the beveling of the outer edge of the tray member.

FIG. 1D shows a perspective view of the basic design of the inventions.

FIG. 2A shows a cross section of an alternative embodiments for a round coaster.

In this alternative embodiment, the tray member 20 is shaped with a ½" downward curve of the outer edge 21. The purpose of the downward curved outer edge 21 is to enable one to rotate, move, pull, or push the coaster, using a specially designed wrought iron tool, having an angled tip end.

FIG. 2B shows a narrow ribbed edging 22 on the inner side of the curved edge of the tray member, designed to facilitate a non-slip grasping by the angled tip 23 end of the tool used in moving the heavy planter.

FIG. 2C shows the lower end of the wrought iron tool's 3/8" shaft with:

(a) the shaft bent at a right angle 24 extending 2½", gradually flattened and formed into a pointed end 23.

(b) a wrought iron cross brace 25 for pushing the coaster, welded to the right angle bend of the shaft and angled to fit the downward angle of the outer edge of the tray.

FIG. 2D shows the thin gauged wrought iron cross brace 25 with its 1¾"×1¼" dimensions and rounded corners.

FIG. 2E shows a side view of the cross brace 25 which is slightly bent to conform to the outer edge of the round coaster.

When rotating or pulling the coaster, the tool is positioned with the angled tip end 23 pointing upward. When pushing the coaster, the tool is positioned with the angled tip end 23 pointing downward, and with the cross brace for pushing positioned on top.

FIG. 2F shows the upper end of the tool shaft with a handle 26 for gripping.

In this manner, the invention provides a coaster that:

(a) is durable enough to handle a heavy potted plant.

(b) will allow the safe and easy moving of a heavy potted plant.

(c) offers the option of easily moving a heavy potted plant by the use of a tool rather than by bending down, grasping the top rim of the pot, and moving the potted plant with one's hands.

(d) can serve as a base for a heavy potted plant.

(e) is light in construction and appearance, with clean, smooth lines.

(f) is an aesthetically harmonious, yet unobtrusive, standing base for a potted plant.

It is clear that the present invention creates a highly improved apparatus for the movement of plants.

What is claimed is:

1. An assembly comprising:

a) a wrought iron support member having a generally circular shape and a drain hole substantially in a center thereof, said support member supported by four swivelly connected wheels, said wrought iron support member having a curved edge having ribbing along an underside thereof; and, b) a handle member having a first end configured to engage said ribbing of said support member and a handle on a second end thereof.

2. The assembly according to claim 1, wherein said support member includes a downward lip extending around the entire periphery thereof.

3. The assembly according to claim 2, wherein the first end of said handle member is "J" shaped and adapted to engage said downward lip.

4. The assembly according to claim 3, wherein the first end of said handle member includes a cross plate secured to a bend in said handle member.

5. The assembly according to claim 4, wherein said cross plate is adapted to selectively engage an edge of said wrought iron support member.

6. A transport mechanism for a live plant comprising:

a) a wrought iron support member having a generally circular shape and a drain hole substantially in a center thereof, said support member supported by four swivelly connected wheels, said wrought iron support member having a curved edge having ribbing along an underside thereof; and, b) a handle member having a first end configured to engage said ribbing of said support member and a handle on a second end thereof.

7. The transport mechanism according to claim 6, wherein said support member includes a downward lip extending around the entire periphery thereof.

8. The transport mechanism according to claim 7, wherein the first end of said handle member is "J" shaped and adapted to engage said downward lip.

9. The transport mechanism according to claim 8, wherein the first end of said handle member includes a cross plate secured to a bend in said handle member.

10. The transport mechanism according to claim 9, wherein said cross plate is adapted to selectively engage an edge of said wrought iron support member.

* * * * *